US007063649B2

(12) United States Patent
Szultka et al.

(10) Patent No.: US 7,063,649 B2
(45) Date of Patent: Jun. 20, 2006

(54) MULTIFUNCTIONAL EXERCISE DEVICE

(76) Inventors: Alina Szultka, Alina Szultka, ul. Derdowskiego 5, 89-632 Brusy (PL); Stanislaw Szultka, Stanislaw Szultka, ul. Derdowskiego 5, 89-632 Brusy (PL)

( * ) Notice: Subject to any disclaimer, the term of this patent is extended or adjusted under 35 U.S.C. 154(b) by 137 days.

(21) Appl. No.: 10/343,628

(22) PCT Filed: Aug. 2, 2001

(86) PCT No.: PCT/PL01/00068

§ 371 (c)(1),
(2), (4) Date: Feb. 3, 2003

(87) PCT Pub. No.: WO02/11818

PCT Pub. Date: Feb. 14, 2002

(65) Prior Publication Data

US 2004/0029686 A1 Feb. 12, 2004

(30) Foreign Application Priority Data

Aug. 5, 2000 (PL) ..... 341885

(51) Int. Cl.
*A63B 21/062* (2006.01)
*A63B 21/00* (2006.01)

(52) U.S. Cl. ..... 482/99; 482/135

(58) Field of Classification Search ..... 482/98–104, 482/135–138, 93–97, 133–134
See application file for complete search history.

(56) References Cited

U.S. PATENT DOCUMENTS

| | | | | |
|---|---|---|---|---|
| 4,900,018 | A | 2/1990 | Ish, III et al. | |
| 4,907,798 | A * | 3/1990 | Burchatz | 482/99 |
| 4,955,604 | A * | 9/1990 | Pogue | 482/99 |
| 5,050,872 | A * | 9/1991 | Farenholtz | 482/133 |
| 5,184,992 | A * | 2/1993 | Banks | 482/104 |
| 5,328,430 | A * | 7/1994 | Vittone et al. | 482/102 |
| 5,669,859 | A * | 9/1997 | Liggett et al. | 482/94 |
| 6,231,486 | B1 * | 5/2001 | Lee | 482/101 |

FOREIGN PATENT DOCUMENTS

WO PCT/SK96/00013 12/1996

* cited by examiner

*Primary Examiner*—Gregory L. Huson
*Assistant Examiner*—Fenn C. Mathew

(57) ABSTRACT

The invention composes a multifunctional device for exercising the organs of motion. It solves the problem of maximum increasing the number of exercises with a full protection being ensured for a user against injury. It is mainly characterized by the fact that faces (20) of front posts (23) and rear posts (16, 17) are equipped with a row of hooks (21), adapted for detachable fastening on them two protective bar-bell catchers (22), and travelling transporter (9) has the form of rectangular, opened from below, frame (24), side arms (25) of said frame being equipped with a row of through-seats (27) adapted for detachable mounting in them, in front and in the rear, training grips for lifting (28), or horizontal beam (29).

13 Claims, 10 Drawing Sheets

MULTIFUNCTIONAL EXERCISE DEVICE

BACKGROUND OF THE INVENTION

1. Field of the Invention

The subject of the present invention is a multifunctional device for exercising the human body both with and without load, designed for people who are undergoing physical rehabilitation.

2. Brief Description of the Background of the Invention Including Prior Art

The known multifunctional devices for exercising the human body, for example those known from the US patent specification No. 4.900.018 or PCT/SK96/00013 specification, designed for exercising the human body both with and without load, have a bench with an adjustable seat and a back-rest, and a travelling transporter having an arrangement for changing the load. This arrangement is mounted movably on a frame and works by means of upper and lower tackle hoists. The invention also incorporates rods and hand grips that enable a user to exercise without a load—hence this device constitutes a multifunctional exercise apparatus. In such a device, in general, the possibility to change the load is achieved through the tackle hoist coupled to the travelling transporter and to a unit for changing the load having the form of suspended replaceable weights.

SUMMARY OF THE INVENTION

1. Purposes of the Invention

It is an object of this invention to provide a multifunctional exercise device which maximises the number of exercises possible with full protection being ensured against injury.

This and other objects and advantages of the present invention will become evident from the description which follows.

2. Brief Description of the Invention

The object of the present invention is a maximum increase in a number of exercises possible, both with a load, using free weights as well as weights on guides, and without a load, with the person doing exercises being completely protected from injury.

The embodiment according to the essential features of the invention, in which the multifunctional device has a bench with an adjustable angle of inclination of a seat and of a back-rest, and with a rest for feet, a travelling transporter having an arrangement for changing the load, mounted movably on guides in a frame and connected by means of a cable to an upper and lower tackle hoist and a rod for pulling upwards and hand grips that enable a user to perform exercises without a load, is characterized by the fact that front posts of the frame constituting the face of the device are coupled through two symmetrically mounted upper beams to rear posts of the frame, all posts at the bottom being fixed to a base, and at the top being joined, through the upper beams, by means of a cross-beam, while the vertical faces of the front and rear posts are equipped, in the front and in the rear, for a considerable length, with a row of hooks to enable detachable fastening on them of two protective catchers for a bar-bell and also to act as storage for exercise attachments.

The travelling transporter has the form of a rectangular frame open below, the side arms of which are joined at the top by means of a transporter connecting link, to which the cable of the upper hoist is attached. The fore-portions of the side arms are, over a considerable length, with a row of locating holes in the form of through-seats in the front and in the rear in to which may be fitted training grips for lifting. The grips are horizontally spaced and are wider than the trunk. The trough-seats also serve for detachable mounting of a horizontal beam of the travelling transporter that also has a row of through-seats for detachably mounting the exercise training grips in them.

The bench is mounted movably, along the axis of symmetry of the frame posts, on a carriage having a locking mechanism to enable the carriage to be clamped in any position on the carriage guide fixed to the base.

Another feature of the invention is that the travelling transporter lies symmetrically between the front and rear posts and is movably mounted by means of guide rollers on the guides and can move up and down, and this movement can be effected by the training grips for lifting, through the cable of the upper or lower hoist, or by movement transferred from the training grips mounted in the travelling transporter beam. The side arms of the travelling transporter are equipped with bumpers in their lower portion equipped with bumpers and the guides are equipped with shock absorbers positioned to be struck by these bumpers. The upper connecting link of the travelling transporter is of such a length that at its bottom position, it is situated at a height that does not permit the user's trunk to make contact with it. Building-in of the travelling transporter between the front and rear posts makes it possible for the user to exercise using free weights. To do some exercises it is possible to raise the travelling transporter and position it with the training grips for lifting in such a position, where, after turning the locking device, the protruding cylindrical pins of both of the grips rest on the hooks.

In another, also essential, embodiment of the present invention, the shock absorbers take the form of spiral springs mounted coaxially on guides, while a protective bar-bell catcher consists of coupled brackets, symmetrically shaped in the form of a letter "L" with vertical arms between which are mounted four fixing pins to be placed on the hooks. Other horizontal arms are covered by a flat plate terminating in a projection from their open side.

A further feature of the present invention is that each training grip for lifting consists of a fixing bolt of dimensions and form that make it a close fit in the through-seat, coupled advantageously at a right angle with a cylindrical grip that on one side has a handle part, and on the other is coupled pivotally, also at a right angle, with a locking device having a protruding cylindrical pin. On the fixing bolt is mounted a locking mechanism in the form of a strip joined to it at a right angle and having at its end a pin of a diameter equal to that of the fixing bolt, while the distance between the fixing bolt axis and the axis of the pin is equal to the distance between the axes of the through-seats, whereby the end of the fixing bolt has a formed protection to prevent it slipping out of the through-seat. This protection consists of a pawl in the shape of a roller of a diameter equal to that of the fixing bolt, mounted movably and perpendicularly to its axis on a cylindrical member that terminates in a disk being an extension of the fixing bolt of a diameter equal to that of the fixing bolt and permanently fixed to the cylindrical member.

The embodiment of the invention is characterized also by the fact that outside, from both sides of the travelling transporter arms, are affixed holders in the form of bolts on which exchangeable weights in the form of disks may be fitted. These provide an additional load to the travelling transporter.

Advantageous Effects.

The essential features of the invention considerably increase the number of exercises that are possible using a single device, with the user being fully protected against injury in case of over-exertion, faintness or accidental release of the load. This safety-level has been achieved mainly due to the fact that the device has:

1. Apart from the standard bar-bell—two exercise grips, the reach of which is not within the limits of the user, and which, furthermore, are secured against slipping out, and that enable a wider range of motion to be made in its lower portion.

2. The row of the hooks mounted on the posts facilicate quick putting away of the bar-bell and enable the bar-bell catchers to be installed at any height as protective members preventing the bar-bell falling onto the user's trunk. The bar-bell catchers, after being mounted on the hooks, automatically lock into position. Their construction allows their height on the posts to be raised or lowered by ½ of the distance between the hooks.

3. The travelling transporter is so constructed to make possible exercise attachments to be mounted on it with the possibility to optimally adjust their position for a given exercise, and to the build of the user, and the travelling transporter in its lowest position does allow the user to be contacted by moving parts.

The increase in the number of exercises possible is achieved by:

1. Using the four posts, in pair on each side, which allows exercises using the bar-bell both in the front and to the rear of the movable bench.

2. By mounting the exercise grips in the row of sockets on the traveling transporter, exercises are possible both with and without extra loads.

3. Using the movable bench along the axis of symmetry of the guide, along with the previous advantages, increases the space available for exercises.

Additionally, the device is characterized by the fact that it has greater stability, because there are four posts mounted on the base, two on either side, which creates a rigid and safe integral structure.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The object of this invention is illustrated in a preferable embodiment in the accompanying drawings in which.

DESCRIPTION OF INVENTION AND PREFERRED EMBODIMENT

Figure 1:
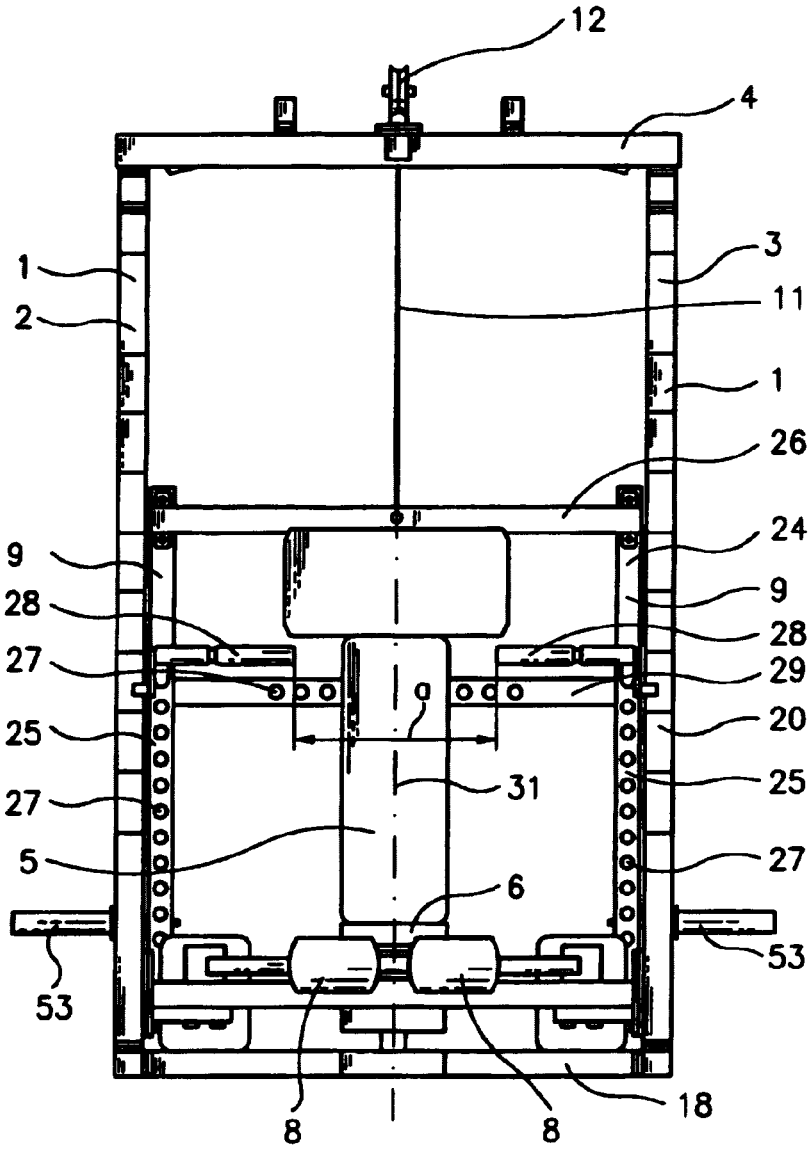
FIG. 1 is a front elevation view of a multifunctional device.
Figure 2:
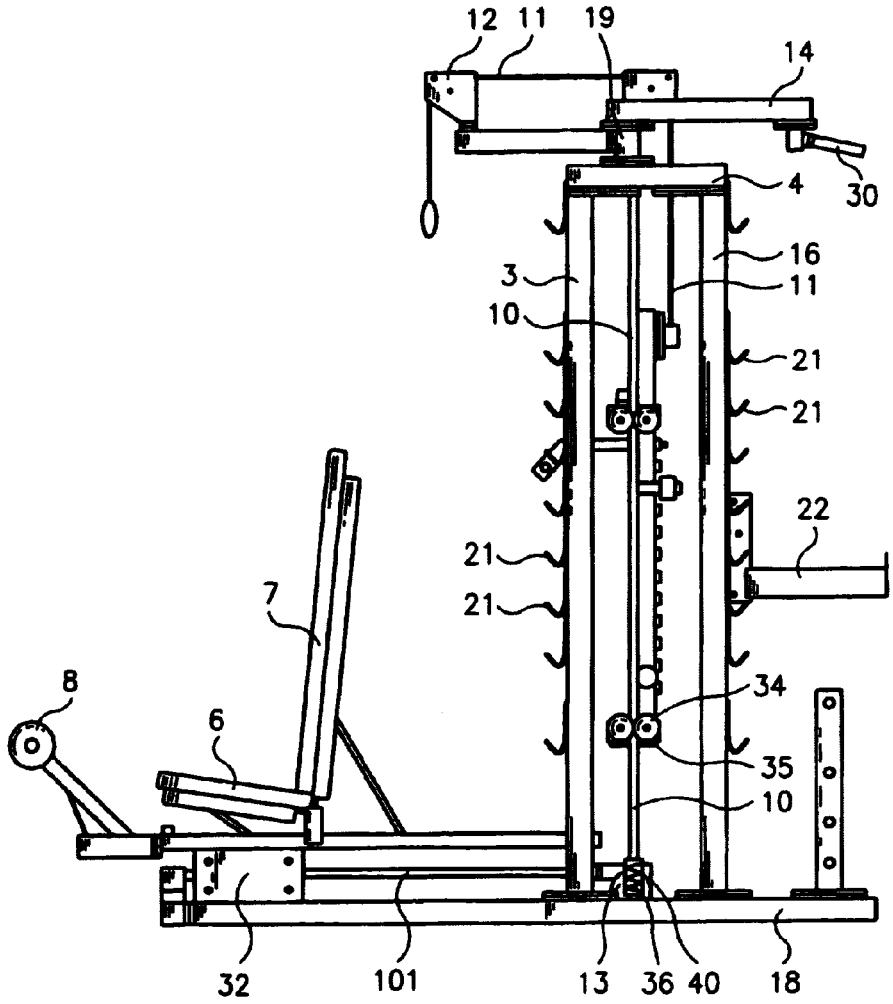
FIG. 2 is a side elevation view of the device with a traveling transporter in an upper position.
Figure 3:
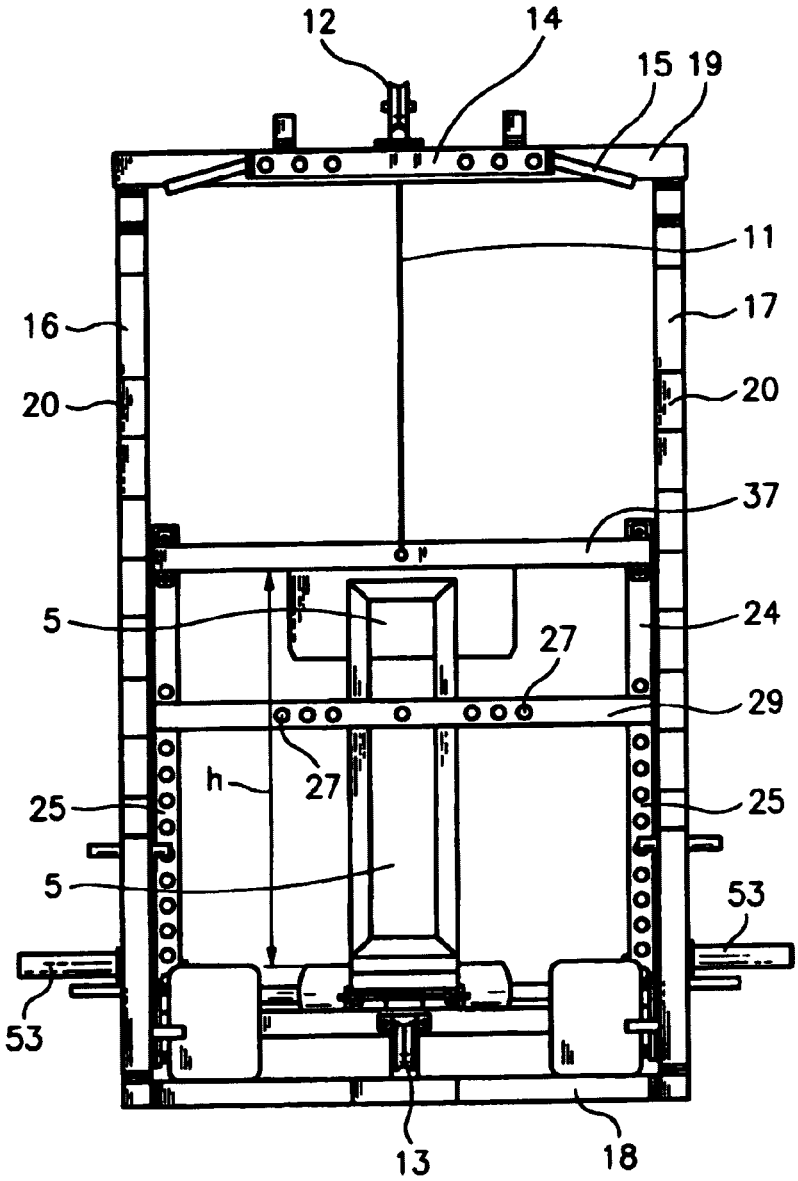
FIG. 3 is a rear elevation view of the device.
Figure 4:
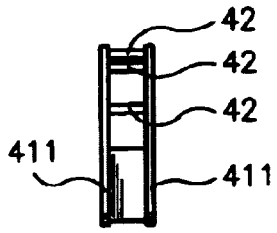
FIG. 4 is a front elevation view of a protective bar-bell catcher.
Figure 5:
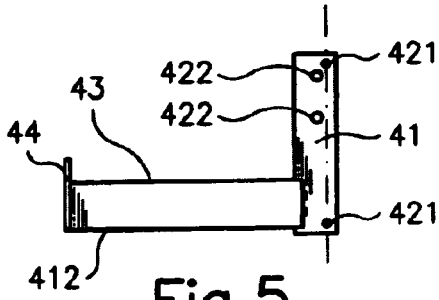
FIG. 5 is a side elevation view of the protective bar-bell catcher.
Figure 6:
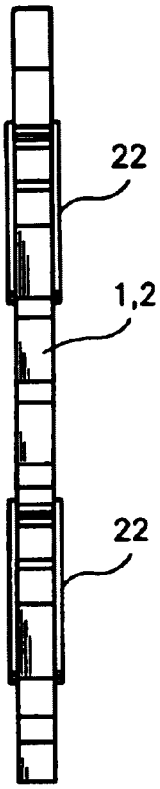
FIG. 6 is a front elevation view showing the protective bar-bell catcher fixed to a post.
Figure 7:
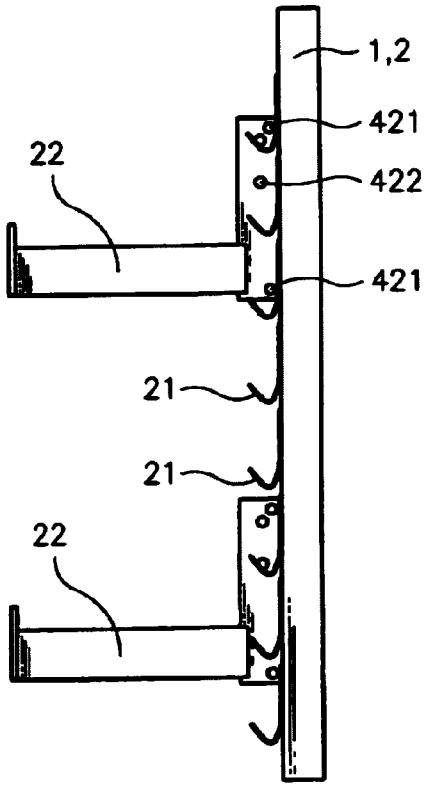
FIG. 7 is a side elevation view showing the protective bar-bell catcher fixed to the post.
Figure 8:
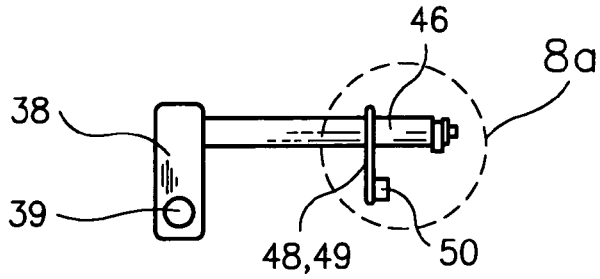
FIG. 8 is a side elevation of a training grip for lifting along the axis of its fixing system.
Figure 8A:
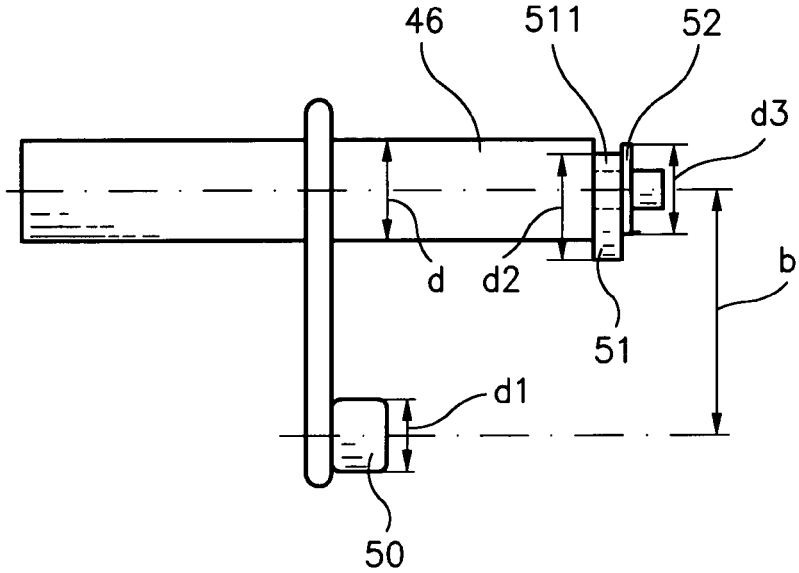
FIG. 8*a* is an enlarged view of the training grip shown in FIG. 8.
Figure 9:
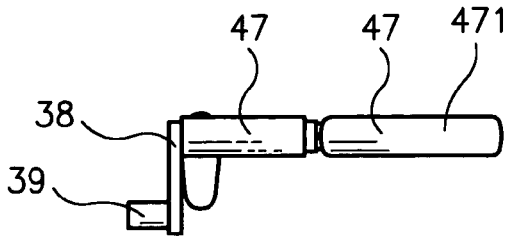
FIG. 9 is a front elevation view of the training grip for lifting along the hand grip.

The exercise device illustrated in FIG. 1 to FIG. 3 has the form of a frame 1 with two front posts 2 and 3 that are coupled through two symmetrically mounted upper beams 4. The device comprises a bench 5 with an adjustable inclination angle of seat 6 and of back-rest 7, and with a foot rest 8, as well as a travelling transporter 9 having an arrangement for changing the load, mounted movably on guides 10 in the frame 1 and connected by means of a cable 11 to upper 12 and lower 13 tackle hoists, a rod for pulling up 14, and hand grips 15 that enable a user to do exercises without a load. In the device front posts 2, 3, of frame 1 constituting the front face of the device are coupled through two symmetrically mounted upper beams 4 to rear posts 16, 17 of frame 1, all posts 2, 3, 16, 17 at their bottom being fixed to a base 18 and at their top being coupled through the upper beams 4, by means of a cross-beam 19.

Faces 20 of the front posts 2, 3 and the rear posts 16, 17 are equipped, to the front and to the rear, over a considerable length, with a row of hooks 21 adapted for two protective bar-bell catchers 22 to be detachable fixed on them and for putting away exercise attachments 23. The travelling transporter 9 is rectangular in form, open from below and has frame 24, side arms 25 which are coupled at the top by means of a transporter connecting link 26, to which the upper hoist cable 11 is attached. Side arms 25 in their fore part, are equipped, over a considerable length, with a row of through-seats 27 adapted for detachable mounting in them, in front and in the rear of exercise attachments 23 in the form of training grips for lifting 28, horizontally spaced at a width "a" greater than the width of the trunk of the user, or for detachable mounting of a horizontal beam 29 of the travelling transporter 9 that also has a row of through-seats 27 to enable exercise training grips 30 to be detachably mounted in them.

A bench 5 illustrated diagrammatically in FIGS. 14 to 17 in four positions, is mounted movably along the axis of symmetry of posts 31 of frame 1, on a carriage 32 having a position locking mechanism 33 on a guide 101 of the carriage 32 fixed to the base 18.

The traveling transporter 9 is built in symmetrically between the front posts 2, 3 and the rear posts 16, 17, and movably, through guide rollers 34, on guides 10. It can move up and down, and this movement can be caused by moving the training grips for lifting 28 through the cable 11 of the upper hoist 12 or the lower hoist 13, or by the movement transferred from the training grips 30 mounted in the beam 4 of the travelling transporter 9. The side arms 25 of the travelling transporter 9 are equipped with bumpers 35 in their lower portion and the guides 10 are equipped with shock absorbers 36 in the lower portion and adapted to strike these bumpers. An upper connecting link 37 of the travelling transporter 9, in its bottom position, is situated at a height "h" that does not allow contact with the user's trunk. The building-in of the travelling transporter 9 between the front posts 2, 3 and the rear posts 16, 17 enable the user to exercise using free weights. To do some exercises it is possible to raise the travelling transporter 9 and set it with the training grips for lifting 28 at such a point where, after turning locking device 38, protruding cylindrical pins 39 of both of the grips rest on the hooks 21. The shock absorbers 36 have the form of spiral springs 40 mounted coaxially on the guides 10.

A protective bar-bell catcher 22, illustrated diagrammatically in FIG. 4 to FIG. 7, consists of coupled brackets 41, symmetrically shaped in the form of letter "L" that have four mounted fixing pins 42 between vertical arms 411 to be placed on hooks 21, and other horizontal arms 412 covered by a flat plate 43 terminating in a projection 44. Two pins 421 of the four fixing pins 42 are mounted symmetrically one above the other, near the outer side edges of arms 411 and they serve as supporting pins, while the two remaining pins 422 situated in the axis of symmetry of these vertical arms, in their upper portion, function as catching pins.

Each training grip for lifting 28, illustrated diagrammatically in FIGS. 8, 8*a* to FIG. 13, consists of fixing bolt 46 having the shape that makes it close fit for mounting in the through-seat 27, coupled advantageously at right angle with a cylindrical grip 47 that from one side has holding portion 471, and from the other side is coupled pivotally, also at a right angle, with locking device 38 having a protruding cylindrical pin 39. On a fixing bolt 46 is mounted position locking mechanism 48 taking the form of a strip 49 coupled with it at right angle, and having at its end pin 50 of diameter "d1" equal to diameter "d" of the fixing bolt 46, while a distance "b" between the axis of the fixing bolt 46 is equal to a distance "c" between the axes of the through-seats 27, whereby the end of fixing bolt 46 has a formed protection to prevent slippage out of the through-seat 27. This protection consists of a pawl 51 in the shape of a roller of a diameter "d2" equal to the diameter "d" the of fixing bolt 46, mounted movably, perpendicularly to its axis on a member 511 that is terminated in a disk 52 being an extension of the fixing bolt 46 of a diameter "d3" equal to the diameter "d" of the fixing bolt 46 and permanently fixed to a member 511.

Figure 10:
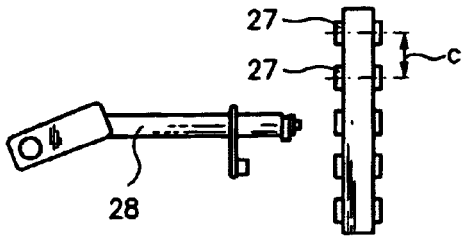
FIG. 10 is a view of the training grip for lifting before being inserted.
Figure 11:
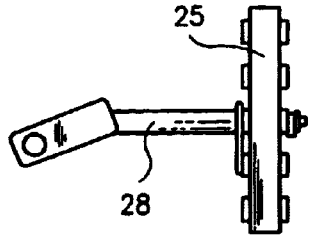
FIG. 11 is a view of the training grip for lifting after being put into the travelling transporter seat.
Figure 12:
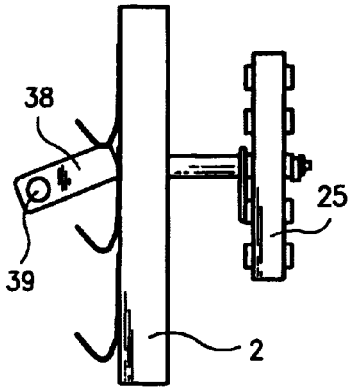
FIG. 12 is a view of the training grip for lifting unhooked (during exercise)
Figure 13:
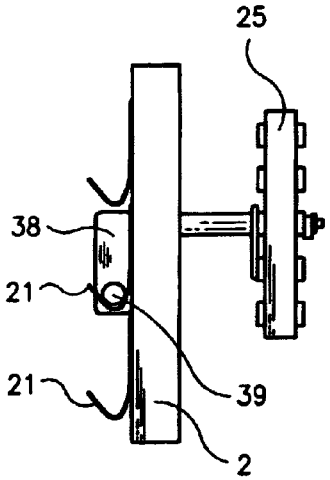
FIG. 13 is a view of the training grip for lifting supported by the hook (in the rest position)
Figure 14:
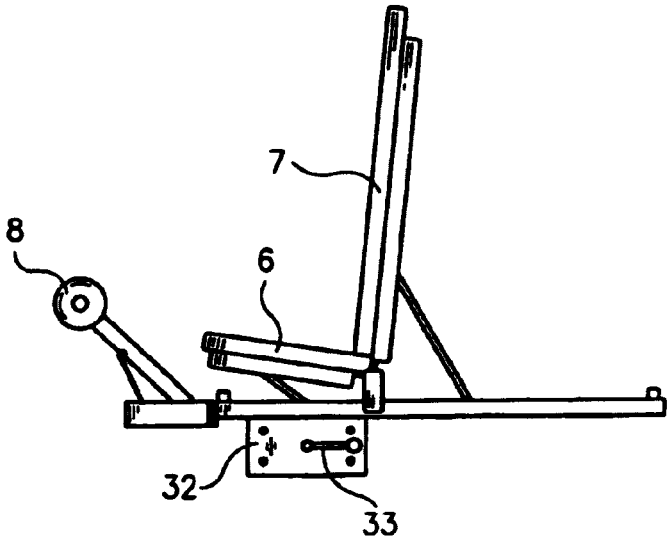
FIG. 14 is a side view of a bench and a carriage.
Figure 15:
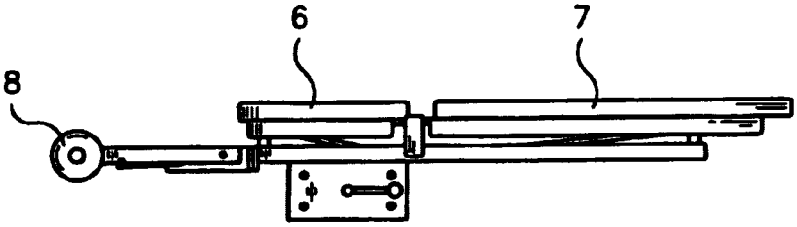
FIG. 15 to FIG. 17 are examples of setting positions of the bench and foot rest.
Figure 16:
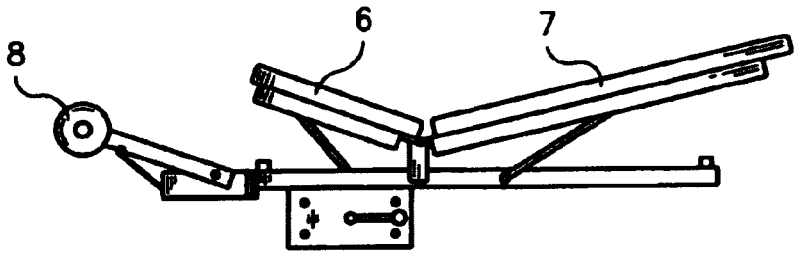
Figure 17:
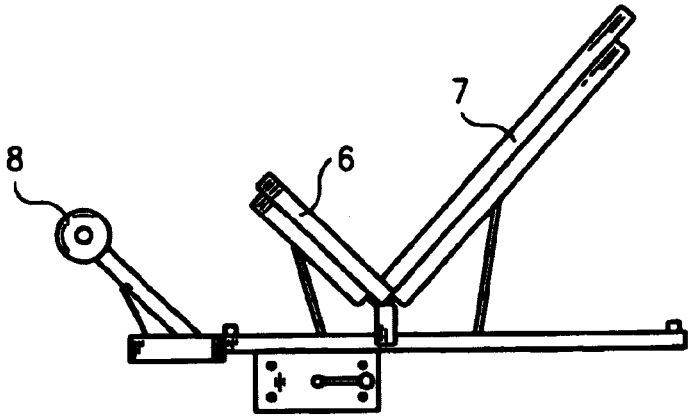

The function of the protection by means of the pawl in the shape of a roller 51 is illustrated in FIG. 10 and FIG. 11. The roller 51, before insertion of the training grip for lifting 28, should be raised and, when it is aligned with the axis of the through-seat 27, it should be pushed into this seat whereupon the roller 51 drops and locks the inserted grip. The locking device for the training grip for lifting 28, securing the grip against turning in the through-seat 27, is illustrated in FIG. 12 and FIG. 13. The interlocking is effected by rotating the locking device 38 and placing it on the hook 21.

Outside, on both sides of the arms 25 of the travelling transporter 9, are fixed holders 53 in the form of bolts to mount on them exchangeable weights 54 in the form of disks, constituting an additional load on the travelling transporter 9.

Figure 18:
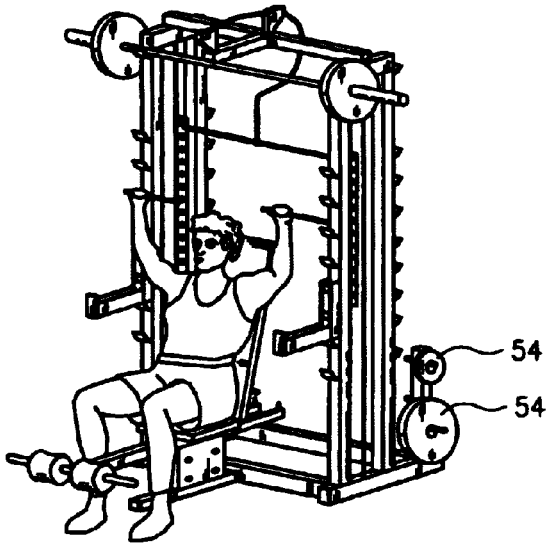
FIG. 18 to FIG. 23 are examples of some exercises being done on the present exercise device.
Figure 19:
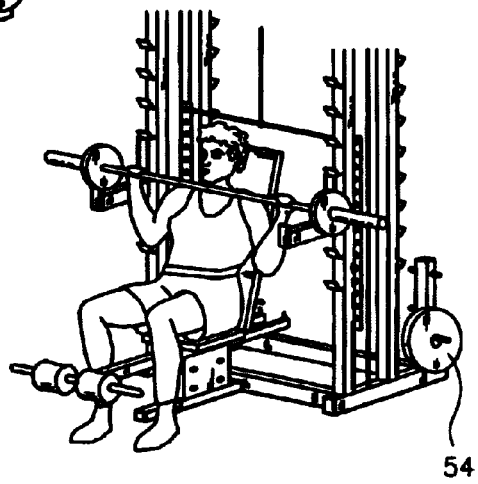
Figure 20:
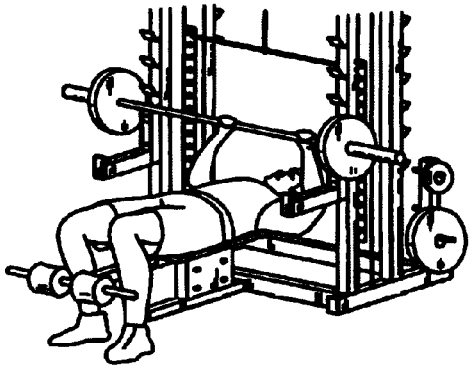
Figure 21:
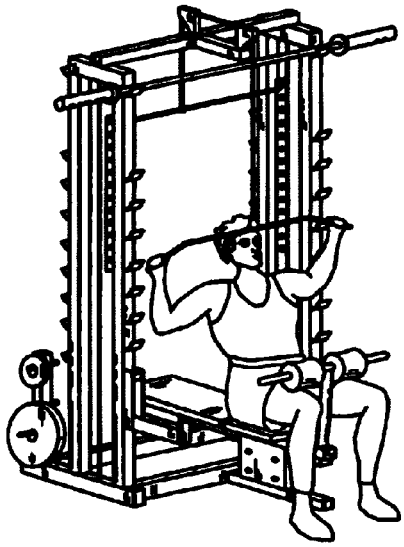
Figure 23:
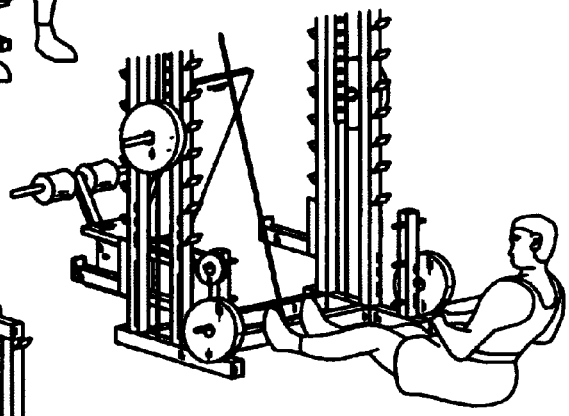
Figure 22:
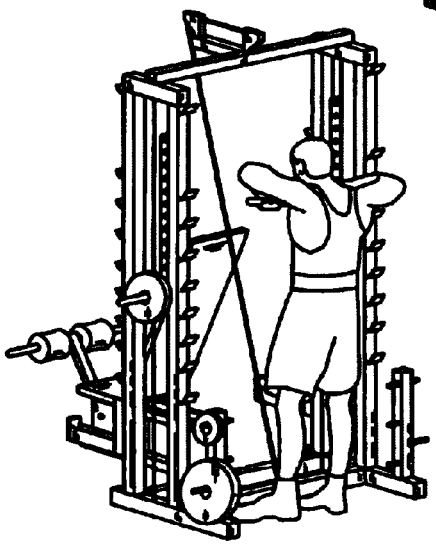

Several examples of exercising using the multifunctional exercise device are illustrated in FIG. 18 to FIG. 23. FIG. 18 illustrates standard lifting in a sitting position by means of the grips using the travelling transporter. FIG. 19 illustrates standard lifting of the bar-bell in the sitting position. FIG. 20 illustrates lifting of the bar-bell in a recumbent position. FIG. 21 illustrates an exercise consisting in pulling down the rod. FIG. 22 illustrates pulling upwards in line with the trunk using the lower hoist. FIG. 23 illustrates pulling the hoist rod towards the trunk using the lower hoist.

The examples given do not cover all the exercise combinations possible, the number of which may be tens of combinations, full safety being ensured in all exercises against injuries to the user's body, which is, among other things, the main object of the present invention.

It will be understood that each of the elements described above, or two or more together, may also find a useful application in other types of exercise devices differing from the types described above.

While the invention has been illustrated and described as embodied in the context of a multifunctional device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A multifunctional device for doing exercises with and without a load comprising a frame fixed to a base and provided with an upper tackle hoist and a lower tackle hoist;

a carriage having a locking mechanism to lock the carriage on a guide fixed to the base;

a bench mounted movably on the carriage, the bench with an adjustable inclination angle of a seat and of a back-rest, and with a rest for feet;

a traveling transporter mounted movably on guides in the frame and connected by a cable to the upper tackle hoist and the lower tackle hoist, and having an arrangement for changing the load, a rod for pulling up, and hand grips attached to the rod, wherein front posts of the frame constituting a face of the multifunctional device are coupled to rear posts of the frame through two symmetrically mounted upper beams and wherein the front posts and the rear posts at the bottom are fixed to the base, and at the top are coupled by a cross-beam connected to the upper beams and wherein front faces of the front posts and rear faces of the rear posts are equipped along their length with a row of hooks detachably receiving protective catchers for a bar-bell and and unused exercise attachments, and wherein the traveling transporter consists of a generally rectangular shaped frame, having a horizontal top arm, a pair of vertical side arms, and an open bottom portion, wherein the side arms include a row of through-seats detachably receiving at least one of exercise attachments, training grips and a horizontal beam, wherein the horizontal beam is equipped with a row of through-seats detachably receiving a second set of training grips.

2. The multifunctional device of claim 1 wherein the traveling transporter is symmetrically situated between the front posts and the rear posts, and wherein the side arms of the traveling transporter are, in their lower portion, equipped with bumpers, and wherein the guides are, in their lower portion, equipped with shock absorbers adapted to the bumpers.

3. The multifunctional device of claim 2 wherein the shock absorbers are spiral springs mounted coaxially on the guides.

4. The multifunctional device of claim 1 wherein each of the protective catchers consists of coupled brackets of L-shape having vertical arms coupled by four fixing pins to be placed on the hooks, and horizontal arms covered by a flat plate terminating in a projection above the horizontal arms.

5. The multifunctional device of claim 4 wherein two pins of the four fixing pins placed near outer side edges of the vertical arms are supporting pins, and wherein two remaining pins situated in the symmetry axis of the vertical arms, in their upper portion, are catching pins.

6. The multifunctional device of claim 1 wherein each of the training grips consists of a fixing bolt to be placed in the through-seats, a protection ending the fixing bolt, a cylindrical grip coupled at the right angle with the fixing bolt and having at one side a holding portion, and at the other side locking device with a cylindrical pin, and a position locking mechanism having a strip joined to it the fixing bolt at right angle and a pin of a diameter equal to a diameter of the fixing bolt wherein a distance between an axis of the fixing bolt and an axis of the pin is equal to a distance between axes of the through-seats.

7. The multifunctional device of claim 1 wherein at sides of the side arms of the traveling transporter are fixed bolts for detachably receiving exchangeable weights.

8. The multifunctional device of claim 6 wherein the protection consists of a roller of a diameter equal to a diameter of the fixing bolt, mounted movably, perpendicularly to its axis on a cylindrical member terminated in a disk of a diameter equal to the diameter of the fixing bolt.

9. A multifunctional exercise device comprising front posts provided with front hooks situated in a row and attached to a front surface of the front posts;

rear posts provided with rear hooks situated in a row and attached to a back surface of the rear posts wherein the rear posts are coupled through two symmetrically mounted upper beams to the front posts and wherein the front posts and the rear posts at a bottom are fixed to a base and at a top are coupled through a cross-beam connected to the upper beams and form a frame and wherein the front hooks and the rear hooks are used for detachably receiving protective catchers of a bar-bell and and unused exercise attachments;

a traveling transporter consists of a generally rectangular shaped frame having an upper connecting link, a pair of vertical side arms, and an open bottom portion, wherein the side arms include a row of through-seats, and wherein the traveling transporter is movably mounted to the frame and connected by a cable to upper and lower tackle hoists attached to the frame; and a bench with a feet rest and with an adjustable angle of inclination of a seat and of a back-rest wherein the bench is mounted movably, on a carriage having locking mechanism to enable the carriage to be clamped to a guide fixed to the base.

10. A multifunctional exercise device comprising a left front post provided with left front hooks situated in a row and attached to a front surface of the left front post;

a left rear post provided with left rear hooks situated in a row and attached to a back surface of the left rear post wherein the left rear post is coupled through a left upper beam to the left front post and wherein the left front post and the left rear post at a bottom are fixed to a base;

a right front post provided with right front hooks situated in a row and attached to a front surface of the right front post;

a right rear post provided with right rear hooks situated in a row and attached to a back surface of the right rear post wherein the right rear post is coupled through a right upper beam to the right front post and wherein the right front post and the right rear post at a bottom are fixed to the base and wherein the right upper beam and the left upper beam are connected through a cross-beam and form a frame together with the left rear post, the left front post, the right rear post and the right front post and wherein the right front hooks, the right rear hooks, the left front hooks and the left rear hooks are used for detachably receiving protective catchers of a bar-bell and and unused exercise attachments;

a traveling transporter consists of a generally rectangular shaped frame having an upper connecting link, a pair of vertical side arms, and an open bottom portion, wherein the side arms include a row of through-seats, and wherein the traveling transporter is movably mounted to the frame and connected by a cable to upper and lower tackle hoists attached to the frame; and a bench with a feet rest, a seat and a back-rest having an adjustable angle of their inclination wherein the bench is mounted movably, along an axis symmetry of the frame, on a carriage having locking mechanism to enable the carriage to be clamped to a guide fixed to the base.

11. The multifunctional device of claim 10 wherein the protective catchers consist of coupled brackets of L-shape, each having four fixing pins to be placed on the right rear hooks, the left rear hooks, the right front hooks and the left front hooks and situated between vertical arms and having a flat plate covering horizontal arms and terminating in a projection from an open side of the horizontal arms.

12. The multifunctional device of claim 10 further comprising a training grip attached to the traveling transporter and consisting of a fixing bolt fitting to the through-seats and coupled at a right angle with a cylindrical grip having at one end a holding portion and at the other end coupled pivotally at a right angle with a locking device having a protruding cylindrical pin;

a position locking mechanism mounted on the fixing bolt and having a strip joined to the fixing bolt at right angle and having at its end a pin of a diameter equal to a diameter of the fixing bolt wherein a distance between an axis of the fixing bolt and an axis of the pin is equal to a distance between axes of neighbouring through-seats and wherein an end of the fixing bolt has a protection to prevent slippage out of the through-seats.

13. The multifunctional device of claim 12 wherein the protection to consists of a roller of a diameter equal to the diameter of the fixing bolt mounted movably perpendicularly to its axis on a member terminated in a disk being an extension of the fixing bolt and having a diameter equal to the diameter of the fixing bolt and permanently fixed to the member.

* * * * *